US008011977B2

(12) United States Patent
Tsuruta et al.

(10) Patent No.: US 8,011,977 B2
(45) Date of Patent: Sep. 6, 2011

(54) CONNECTOR WITH RETAINER PROJECTIONS INTEGRAL WITH CONNECTOR HOUSING

(75) Inventors: Satoshi Tsuruta, Yokkaichi (JP); Takeshi Ishibashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/861,063

(22) Filed: Aug. 23, 2010

(65) Prior Publication Data

US 2011/0053403 A1 Mar. 3, 2011

(30) Foreign Application Priority Data

Aug. 25, 2009 (JP) ..... 2009-194530

(51) Int. Cl.
*H01R 13/514* (2006.01)

(52) U.S. Cl. ..... 439/752

(58) Field of Classification Search ..... 439/752, 439/595, 752.5, 357, 352
See application file for complete search history.

(56) References Cited

U.S. PATENT DOCUMENTS

| | | | | |
|---|---|---|---|---|
| 5,035,648 | A * | 7/1991 | Kuiper-Moore | 439/595 |
| 6,371,796 | B2 * | 4/2002 | Fukuda | 439/489 |
| 6,375,502 | B2 * | 4/2002 | Yoshida et al. | 439/595 |
| 6,692,288 | B2 * | 2/2004 | Nimura | 439/352 |
| 7,083,471 | B2 | 8/2006 | Hayashi | |
| 7,090,524 | B2 * | 8/2006 | Tanimoto et al. | 439/352 |
| 7,131,855 | B2 * | 11/2006 | Saitoh | 439/357 |
| 7,476,133 | B2 * | 1/2009 | Tanaka et al. | 439/752 |
| 7,661,985 | B2 * | 2/2010 | Ishikawa | 439/595 |
| 7,661,987 | B2 * | 2/2010 | Adachi et al. | 439/595 |

* cited by examiner

*Primary Examiner* — Chandrika Prasad
(74) *Attorney, Agent, or Firm* — Gerald E. Hespos; Michael J Porco

(57) ABSTRACT

A connector has first and second housings (10A, 30A) that can be fit together along a fit-on direction. A female terminal (14) is mounted in a cavity (12) of a first housing (10A). A lance (19) is formed inside the first housing (10A) and locks the female terminal (14) in the cavity (12). The lance (19) can deform elastically in the flexibility allowance space (22) to unlock the female terminal (14). A retainer projection (34) is provided in a second housing (30A) and projects along a fit-in direction of the first and second housings (10A, 30A). The retainer projection (34) penetrates into the flexibility allowance space (22) as the first and second housings (10A, 30A) are fit together to prevent the lance (19) from flexing in an unlocking direction.

8 Claims, 10 Drawing Sheets

CONNECTOR WITH RETAINER PROJECTIONS INTEGRAL WITH CONNECTOR HOUSING

BACKGROUND OF THE INVENTION

1. Field of the Invention

The invention relates to a connector having a lance for locking a terminal fitting thereto.

2. Description of the Related Art

U.S. Pat. No. 7,083,471 relates to a connector for supplying an electric power to an apparatus mounted on an electric car such as a motor, inverter or the like accommodated inside a metal case. The connector has an electric wire-side connector mounted at an end of an electric wire and an equipment-side connector mounted on a mounting hole that penetrates through the case. The electric wire-side connector and the equipment-side connector are fit on each other to bring terminals in both connectors into contact with each other.

Cavities penetrate the housing of the electric wire-side connector and terminal fittings connected to ends of electric wires are accommodated in the cavities. Each terminal fitting has a lance-locking hole formed therein. An elastically deformable lance is formed in each cavity for locking the terminal fitting. The terminal fitting flexes a locking lance during insertion into the cavity. Thus, the lance deforms elastically into a flexibility allowance space adjacent to the direction in which the lance deforms. The lance then returns elastically to lock the terminal fitting in the housing in a removal-prevented state.

A retainer formed separately from the housing often is used to penetrate into the flexibility allowance space for the lance to prevent the lance from flexing and to keep the lance locked to the lance-locking hole. The terminal fitting is locked doubly to the lance and the retainer and thus is retained securely inside the housing.

The above-described construction requires the connector to have the housing and the separate retainer. Additionally, the housing must be formed with a mounting part where the retainer is mounted and a locking mechanism for holding the retainer on the mounting part. Thus, the housing is large and requires plural component parts.

The invention has been completed in view of the above-described situation. It is an object of the present invention to provide a connector which is capable of holding a terminal fitting at a high strength by a double locking construction and can be made to be compact.

SUMMARY OF THE INVENTION

The invention relates a connector with first and second housings that can be fit together. The housings have cavities for accommodating terminal fittings. A first terminal fitting is mounted in the cavity of the first housing. A lance is formed in the first housing and locks the first terminal fitting mounted in the cavity to prevent the first terminal fitting from being removed from the cavity. The lance can deform elastically in a flexibility allowance space in the first housing to unlock the first terminal fitting. A second terminal fitting is provided in the cavity of the second housing and is connectable to the first terminal fitting when the housings are fit together. A retainer projection is provided in the second housing and projects in a fit-on direction in which the first and second housings are fit together and penetrates into the flexibility allowance space. The retainer projection is guided by the first housing in an operation of fitting the first and second housings together and prevents the lance from flexing in an unlocking direction.

Thus, the first terminal fitting is locked doubly and is held at a high strength.

A lance will not be in a normal locking state if the terminal fitting has not been inserted sufficiently and will project into the flexibility allowance space. This deformed lance will contact the retainer projection during an operation of fitting the first and second housings together, thereby preventing the retainer projection from penetrating properly into the flexibility allowance space and preventing complete connection of the first and second housings. This locking-inadequate state of the first terminal fitting can be detected immediately. In addition, the retainer projection is formed unitarily with the second housing and functions to guide the first housing and second housings together. Furthermore, the unitary formation of the retainer projection with the second housing reduces the number of component parts to simplify inventory management and makes the connector compact.

The first housing may have two cavities, and the lances may be located at a side of each of the cavities near a center of the first housing. In this construction, the two retainer projections that prevent the lance from flexing in an unlocking direction are provided near the center of the first housing. Therefore, the retainer projections are not likely to be broken.

The first housing may have a fit-on detection connector disposed between the lances. The retainer projections are disposed with the fit-on detection connector sandwiched between the retainer projections in an operation of fitting the first and second housings together. In this construction, the fit-on detection connector is used to guide the retainer projection into the flexibility allowance space, thus utilizing the space effectively and making the entire connector compact.

The first and the second housings preferably are provided with a bolt and a female screw part respectively so that the bolt is screwed into the female screw part to fit the first and second housings together. A length of the bolt is set so that screwing the bolt into the threaded hole starts after a front end of the retainer projection penetrates into the flexibility allowance space during a fit-on of the housings. Thus, the lance and the retainer projection will not be broken by forcibly screwing the bolt into the female screw part in a locking-inadequate state where the lance projects into the flexibility allowance space.

The connector of the invention can be compact and can hold the terminal fitting at a high strength by the double locking construction.

DETAILED DESCRIPTION OF THE PREFERRED EMBODIMENTS

The connector assembly of the invention is illustrated in FIGS. 1 through 10 and is exemplified for supplying electric power to equipment mounted on a car (for example, motor, inverter, and the like mounted on hybrid car). The connector assembly has an electric wire-side connector 10 (see FIG. 1) that can be fit on an equipment-side connector 30 (see FIG. 2) that is fixed to the equipment. In the description made below, the fit-on ends of the electric wire-side connector 10 and the equipment-side connector 30 are referred to as front ends. The equipment has an unshown metal case with a shielding function and an unshown connector-mounting hole penetrates through the case.

Figure 1:
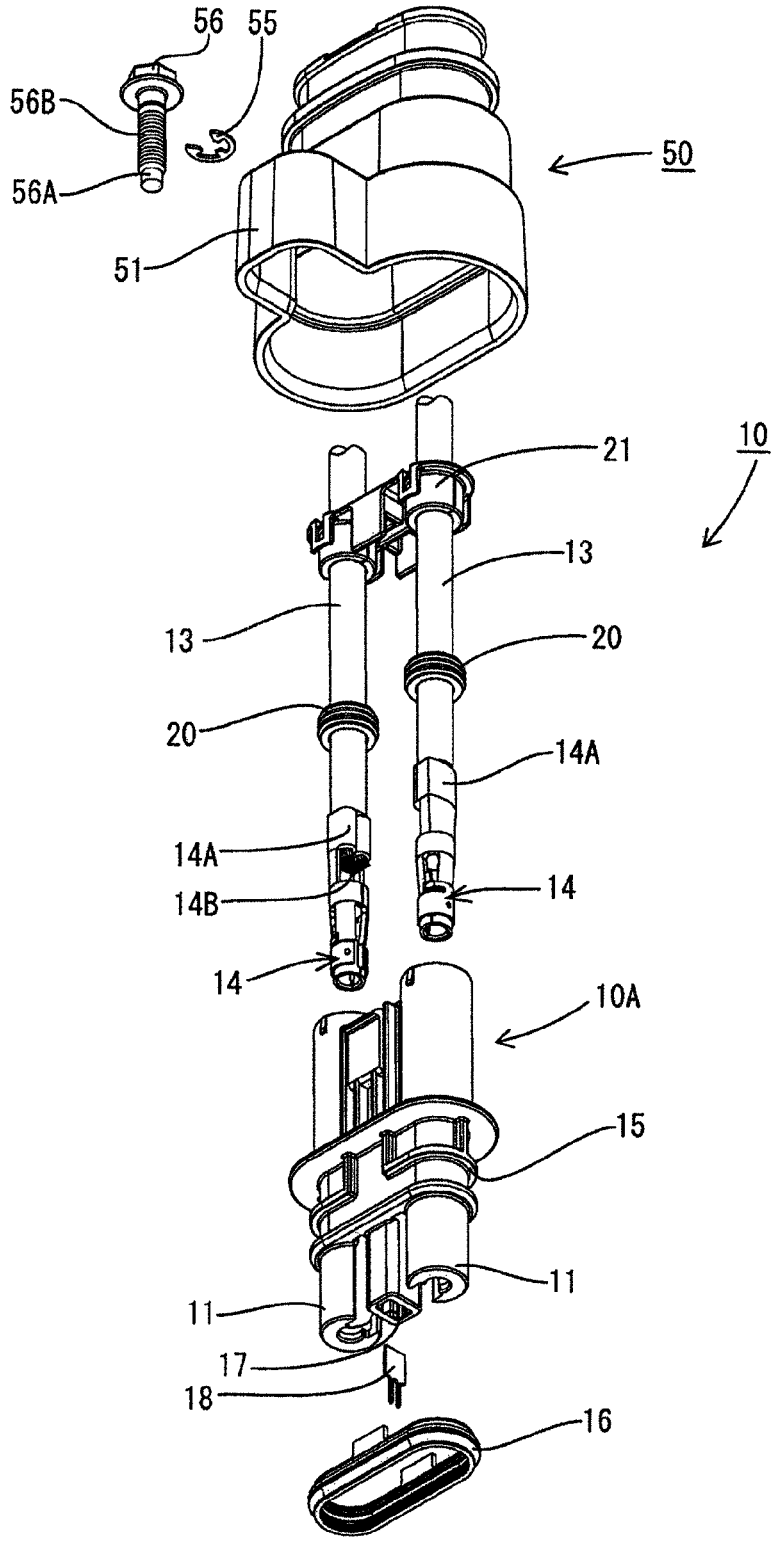
FIG. 1 is an exploded perspective view showing an electric wire-side connector of an embodiment of the present invention.
Figure 4:
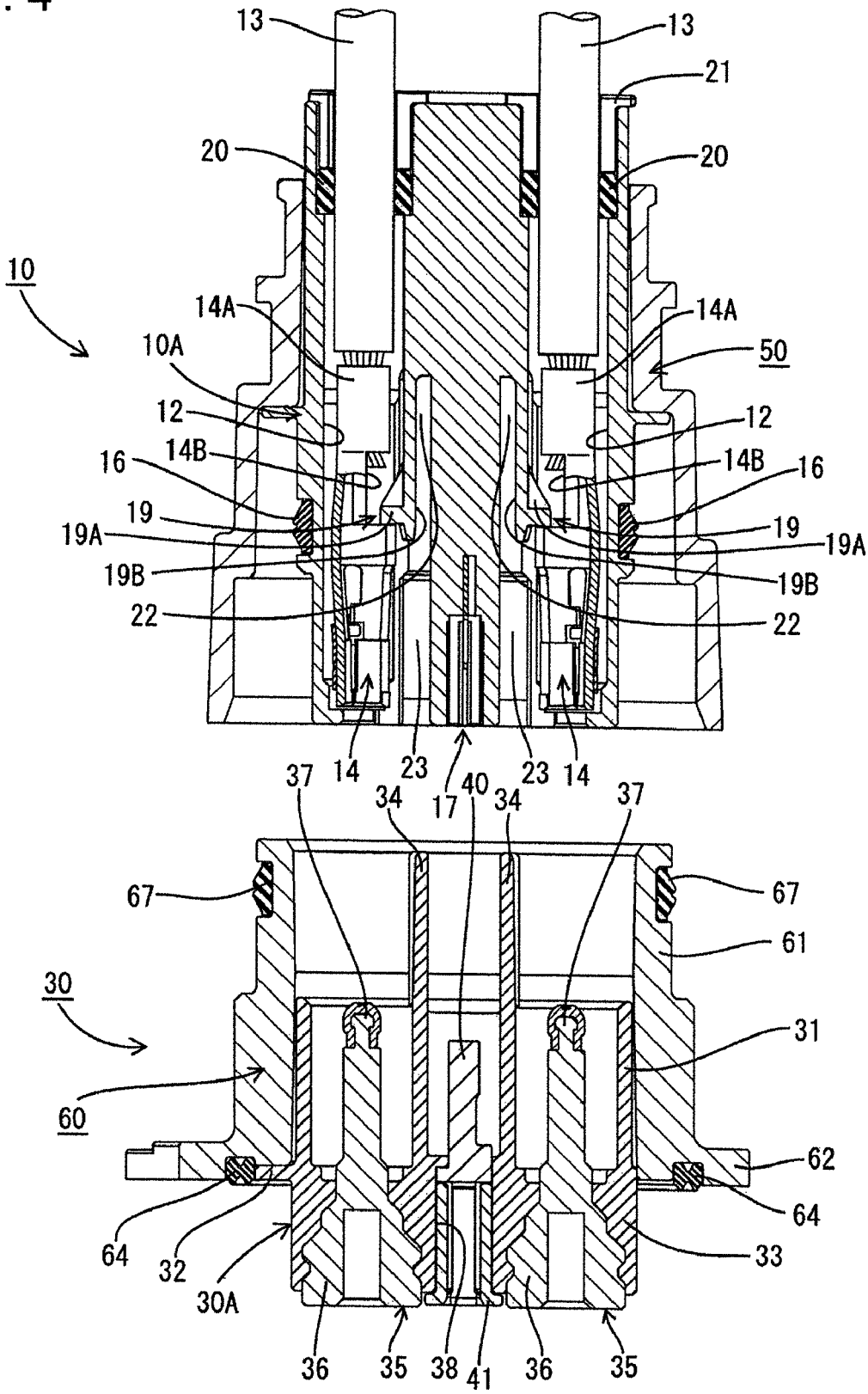
FIG. 4 is a front-side sectional view showing the state before the electric wire-side connector and the equipment-side connector are fitted on each other in the embodiment.
Figure 5:
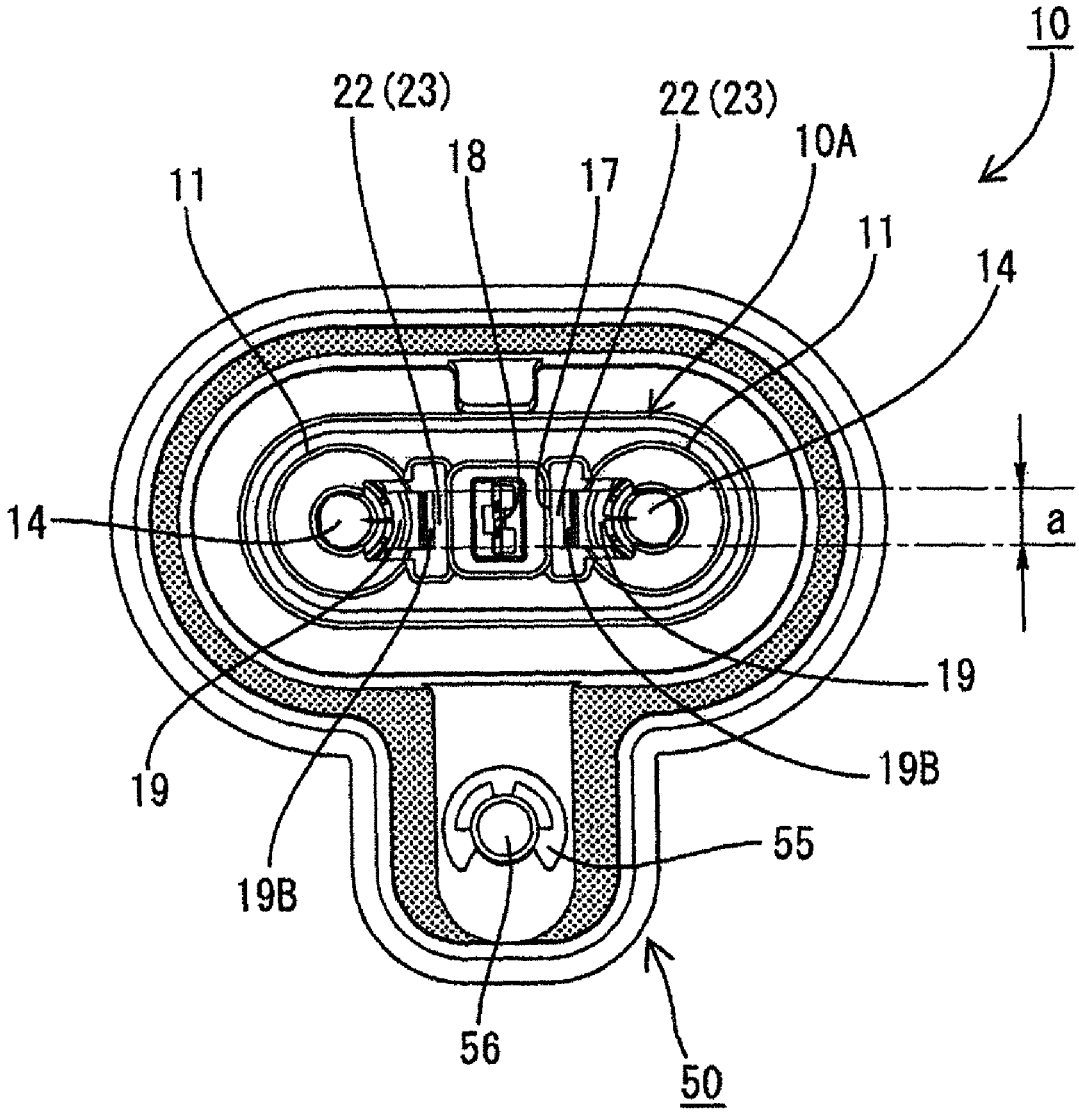
FIG. 5 is a plan view showing a fit-on side of the electric wire-side connector to be fitted on the equipment-side connector in the embodiment.

The electric wire-side connector 10 has a first housing 10A made of synthetic resin and formed with two integrally formed tubes 11 spaced laterally at a predetermined interval, as shown in FIGS. 1 and 4. A cavity 12 extends longitudinally through each tube 11 and a female terminal 14 connected to an electric wire 13 can be inserted into each cavity 12 from the rear. An elliptic O-ring accommodation groove 15 extends around both tubes 11 at a middle portion of the tubes 11 in their longitudinal direction and a sealing ring 16 is mounted on the O-ring accommodation groove 15.

A square pillar-shaped interlocking fit-on part 17 corresponding to a fit-on detection connector part is provided between the tubes 11 and is spaced from each tube 11. A short-circuit terminal 18 having a pair of male terminals is disposed inside the interlocking fit-on part 17. The short-circuit terminal 18 fits on an interlocking connector 40 on the equipment-side connector 30 to detect whether the electric wire-side connector 10 and the equipment-side connector 30 have been fit together properly.

Figure 3:
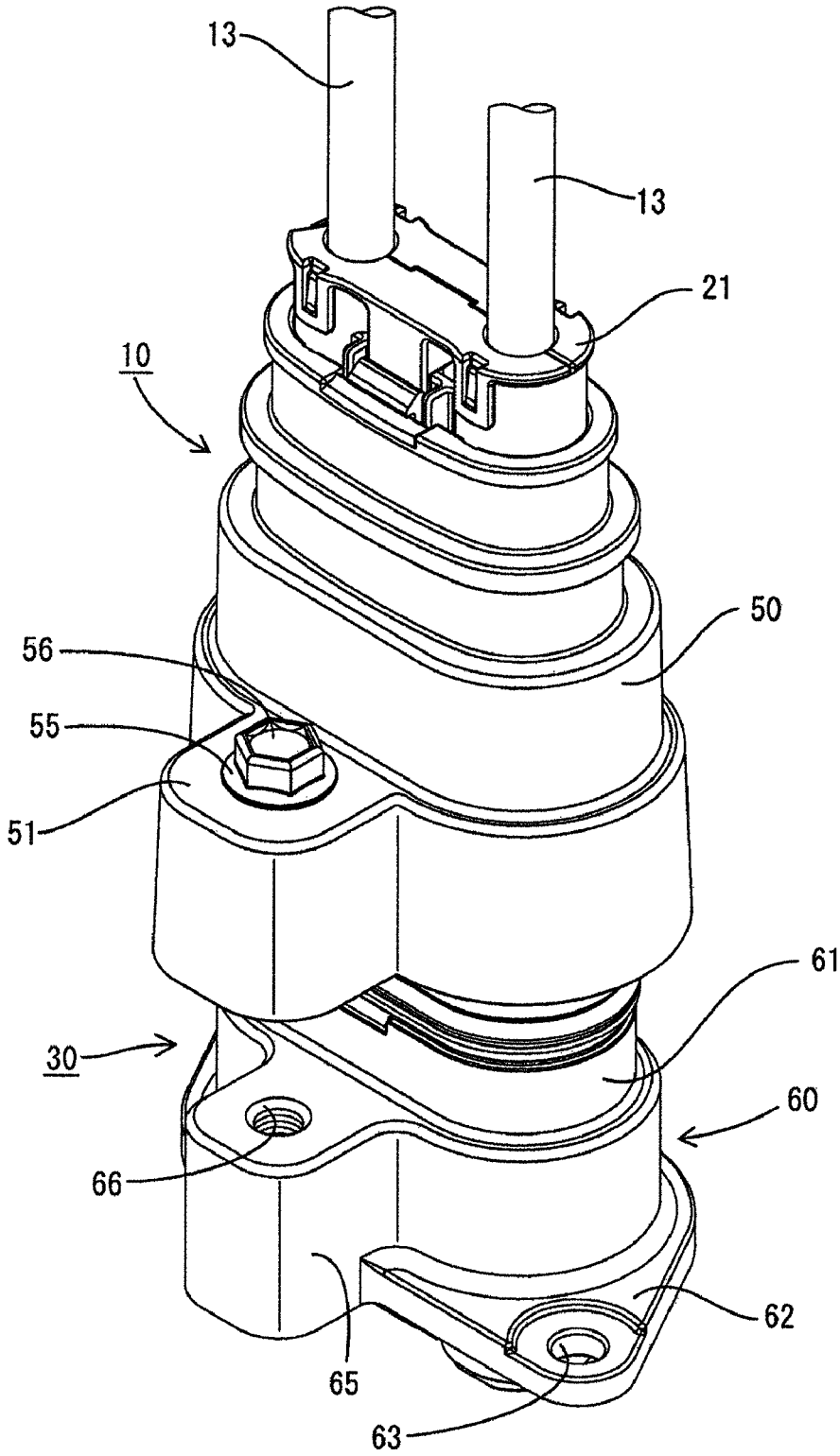
FIG. 3 is a perspective view showing a state before the electric wire-side connector and the equipment-side connector are fitted on each other in the embodiment.

A first shielding shell 50 made of die-casted aluminum is mounted on the first housing 10A from the rear, as shown in FIGS. 1 and 3. A fixing part 51 protrudes from a side of the first shielding shell 50. The fixing part 51 fits on a female screw pedestal 65 projected from a side of a second shielding shell 60 for fixing the first shielding shell 50 to the second shielding shell 60 as described later.

Figure 8:
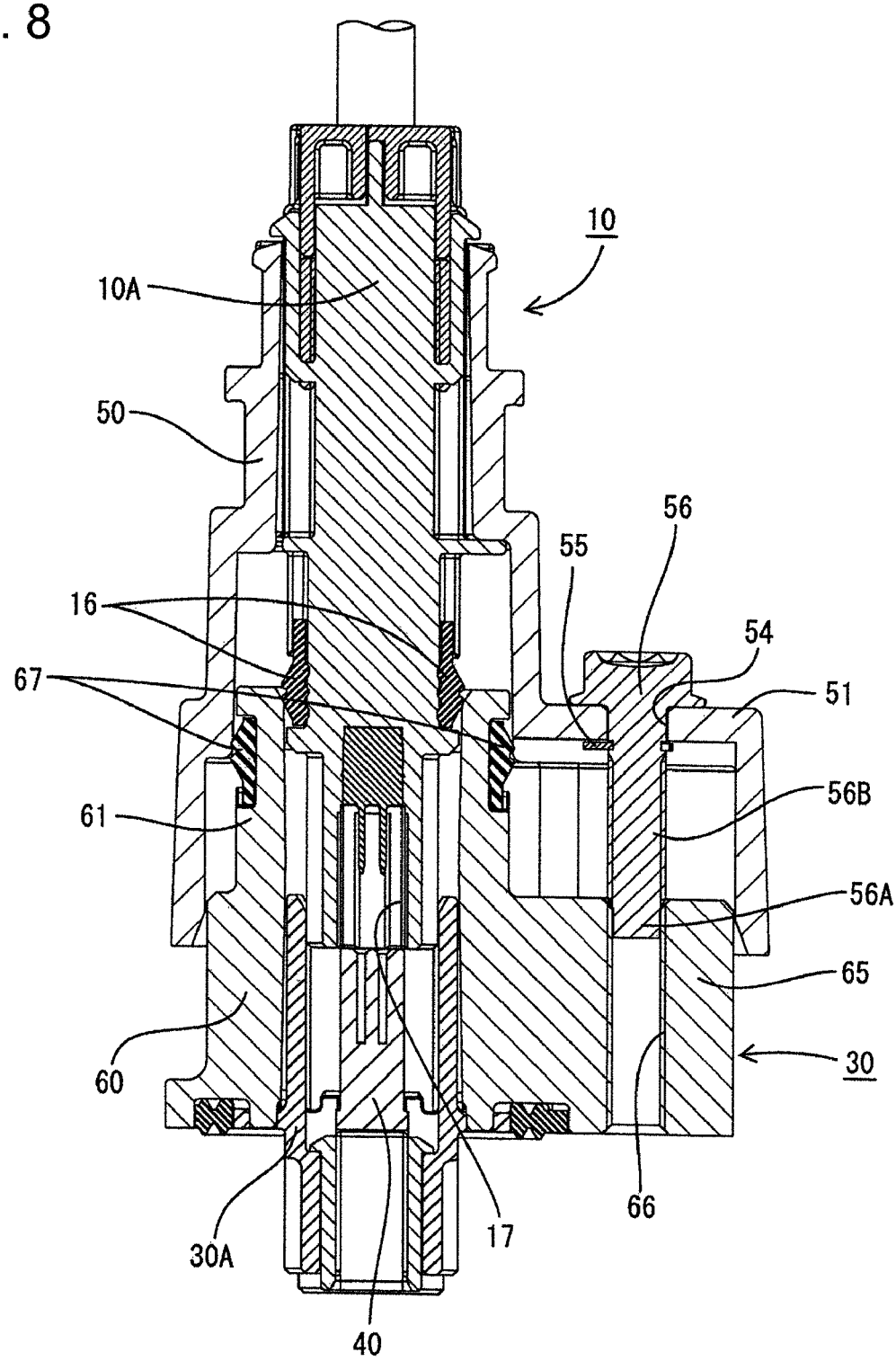
FIG. 8 is a side sectional view showing the state shown in FIG. 7.

A bolt insertion hole 54 is formed through a rear wall of the fixing part 51 of the first shielding shell 50 (see FIG. 8). A fit-on bolt 56 is inserted into the bolt insertion hole 54 and a retaining ring 55 prevents the fit-on bolt 56 from being removed from the bolt insertion hole 54. The fit-on bolt 56 is a hexagonal chamfered setscrew having an unthreaded rod-shaped front end 56A and a screw shaft 56B. The fit-on bolt 56 is screwed into a threaded hole 66 formed on the female screw pedestal 65 of the second shielding shell 60.

As shown in FIG. 1, each female terminal 14 is approximately cylindrical and has opposite front and rear ends. A crimping part 14A is formed at the rear end and a shoulder 34B is formed forward of the crimping part 34A. A rubber stopper 20 is fit on an electric wire 13 and the crimping part 14A is crimped around the stopper 20 and the wire 13. The rubber stopper 20 seals the gap between the electric wire 13 and an inner peripheral surface of the rear half of the tube 11. A back retainer 21 is fit on the electric wire 13 to prevent the rubber stopper 20 from slipping off a rear end of the tube 11.

A lance 19 cantilevers forward in each tube 11 and a locking projection 19A is formed at a front end of the lance 19. The locking projection 19A projects into the cavity 12 and engages the shoulder 14B to prevent the female terminal fitting 14 from being removed from the cavity 12. Each lance 19 is formed on a side of the tube 11 toward the middle and in proximity to the interlocking fit-on part 17 is positioned. Each lance 19 can flex toward the interlocking fit-on part 17 in the center of the electric wire-side connector 10.

A flexibility allowance space 22 is formed between each lance 19 and a side surface of the interlocking fit-on part 17 and is dimensioned to allow the lance 19 to deform sufficiently for the locking projection 19A to disengage from the female terminal 14. A guide groove 23 extends continuously into the flexibility allowance space 22 from the front of the electric wire-side connector 10 and is open toward the fit-on side of both the electric wire-side connector 10 and equipment-side connector 30.

Figure 2:
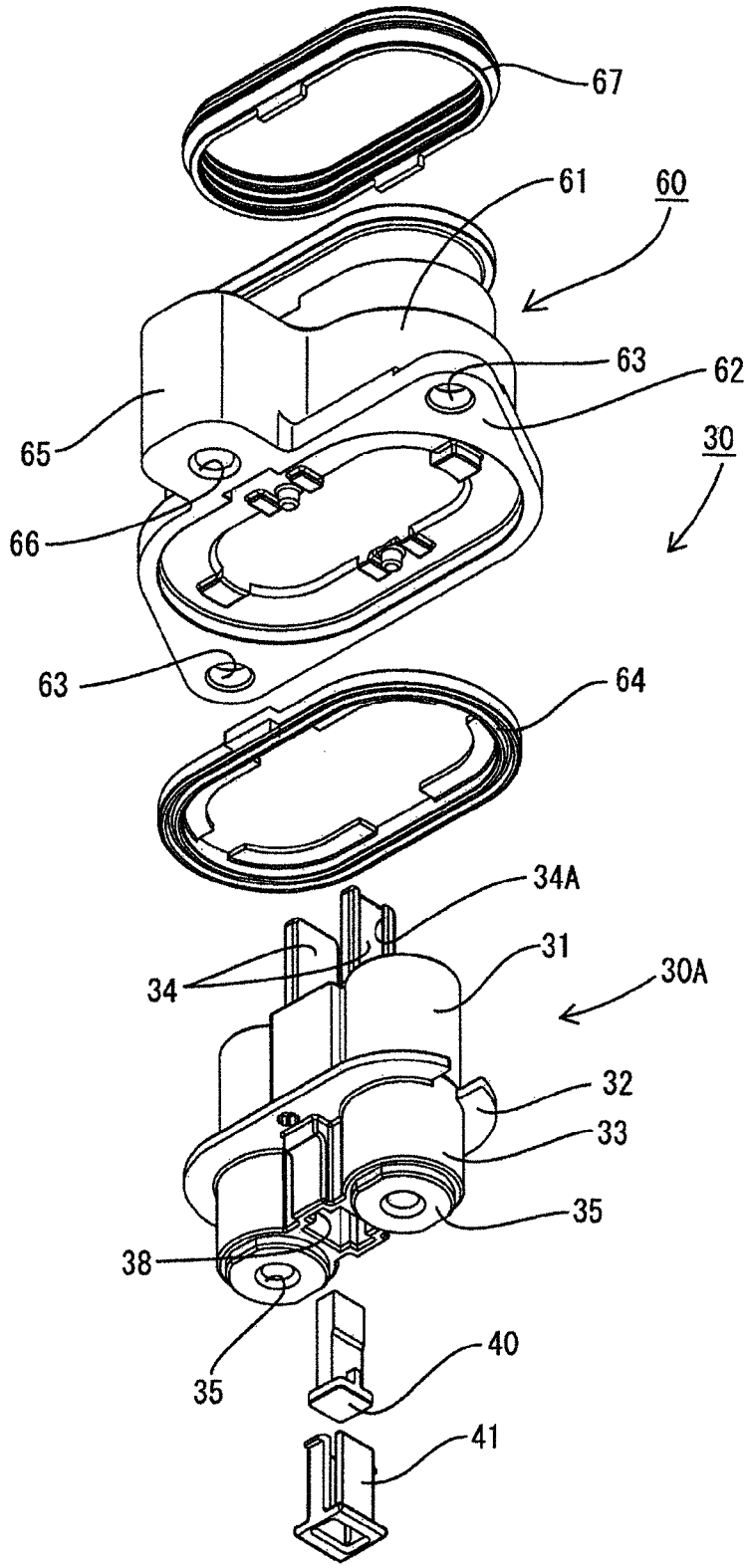
FIG. 2 is an exploded perspective view showing an equipment-side connector of the embodiment of the present invention.

The equipment-side connector 30 has a second housing 30A made of synthetic resin. As shown in FIGS. 2 and 4, the second housing 30A has two cylindrical hoods 31 that can receive the tubes 11 of the electric wire-side connector 10 respectively. The second housing 30A has a plate-shaped flange 32 projected outward entirely from a proximal side of the cylindrical hood 31 and an equipment-side connection part 33 projected rearward from a rear surface of the flange 32.

The second shielding shell 60 is made of die-casted aluminum and is fit on the second housing 30A from the front. As shown in FIGS. 2 and 4, the second shielding shell 60 covers the flange 32 and the entire peripheral surface of the cylindrical hoods 31. A front portion of the second shielding shell 60 is open. The second shielding shell 60 has a cylindrical second body 61 at the fit-on end of the connector 30 and a mounting flange 62 protrudes out from the entire periphery of a rear end of the second body 61. A screw insertion hole 63 is formed at upper left and lower right corners in FIG. 6 for mounting the equipment-side connector 30 on the unshown case. A rubber packing 64 is provided on a front surface of the flange 32 of the second housing 30A, as shown in FIG. 2, and closely contacts an outer surface of the unshown case to seal the gap between a peripheral edge of the unshown connector-mounting hole and the equipment-side connector 30.

The female screw pedestal 65 projects sideways from the body 61 of the second shielding shell 60 in FIG. 3 and the fixing part 51 of the first shielding shell 50 fits over and encloses the female screw pedestal 65. A threaded hole 66 is formed through the female screw pedestal 65 and can threadedly receive the fit-on bolt 56. As shown in FIG. 2, a shielding-side rubber ring 67 is mounted on the edge of the periphery of the second body 61 of the second shielding shell 60.

Figure 6:
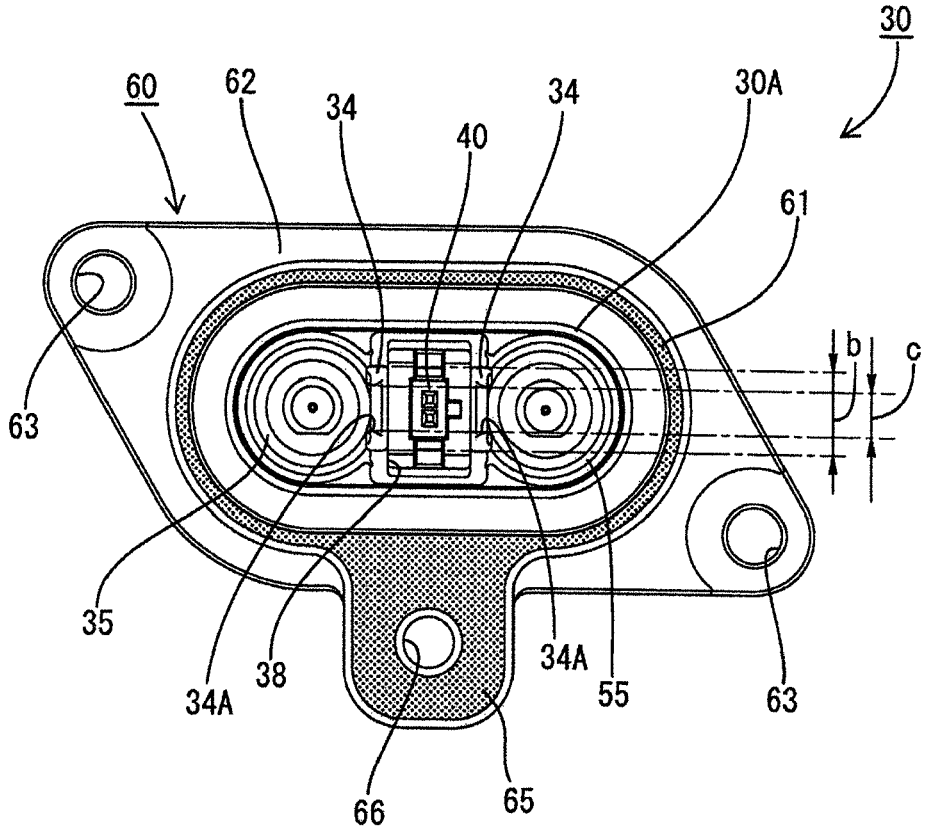
FIG. 6 is a plan view showing a fit-on side of the equipment-side connector to be fitted on the electric wire-side connector in the embodiment.
Figure 7:
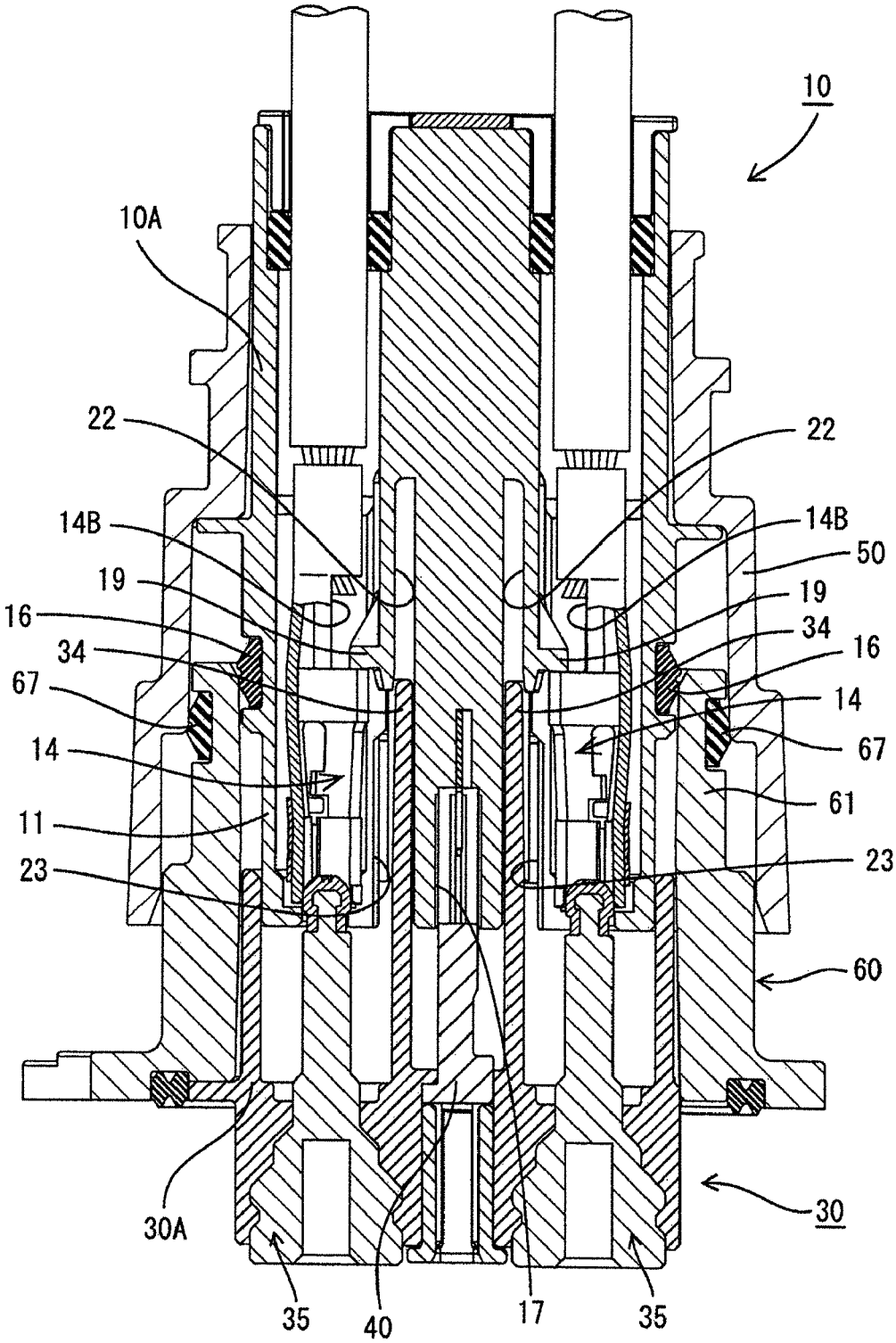
FIG. 7 is a front-side sectional view showing a state in which the electric wire-side connector is temporarily fitted on the equipment-side connector in the embodiment.

Two male terminal fittings 35 are accommodated inside the second housing 30A, as shown in FIGS. 4 and 6. Each male terminal fitting 35 has a body 36 and a pin 37 that is unitary and coaxial with the body 36. The body 36 of the male terminal fitting 35 is to be connected to the equipment. The equipment-side connection part 33 is molded around the body 35 of each male terminal fitting 20 and the pin 37 projects inside the cylindrical hood 31.

An interlocking accommodation part 38 penetrates longitudinally through the equipment-side connection part 33 at approximately the middle of the terminal body parts 36 in its width direction, as shown in FIGS. 2 and 4. The interlocking connector 40 is inserted into the interlocking accommodation part 38 from the side of the equipment-side connection part 33. An interlocking retainer 41 is mounted on the interlocking connector 40 from the rear and prevents the interlocking connector 40 from being removed from the second housing 30A.

Two spaced apart plate-shaped retainer projections 34 extend forward from an inner rear wall of the cylindrical hood 31, as shown in FIGS. 2 and 4. About the front half of each retainer projection 34 projects beyond a front end of the cylindrical hood 31. As shown in FIGS. 4 and 6, the retainer projections 34 extend forward from side walls of the interlocking accommodation part 38. A Width b (see FIG. 6) of each retainer projection 34 exceeds a width a (see FIG. 5) of a back 19*b* of the lance 19 at the side of the flexibility allowance space 22. A fit-on groove 34A is formed on an outer surface of each of the retainer projections 34 (see FIGS. 2, 6) for accommodating the back 19*b* of the lance when the retainer projection 34 penetrates into the flexibility allowance space 22 from the retainer guide groove 23. A width c (see FIG. 6) of the fit-on groove 34A almost equals the width a (see FIG. 5) of the back 19*b* of the lance 19 so that the fit-on groove 34A can accommodate the back 19*b* of the lance 19.

The second shielding shell 60 is fit on the second housing 30A in advance and then the equipment-side connector 30 is mounted on the case by inserting the equipment-side connector 30 into the connector-mounting hole formed through the case. Thus, the second shielding shell 60 is disposed outside an unshown apparatus so that the screw insertion hole 63 of the second shielding shell 60 and a threaded hole of the unshown case overlap. An unshown screw is screwed therein to fix conductively the second shielding shell 60 to the unshown case. The rubber packing 64 waterproofs the gap between an outer wall surface of the unshown case and the second shielding shell 60 as well as the second housing 30A.

The electric wire-side connector 10 then is fit on the equipment-side connector 30. Initially the fixing part 51 of the first shielding shell 50 is placed in position to overlap and fit the female screw pedestal 65 of the second shielding shell 60, as shown in FIG. 3. At this time, the retainer projection 34 of the equipment-side connector 30 is inserted into the retainer guide groove 23 of the electric wire-side connector 10 to fit the electric wire-side connector 10 temporarily on the equipment-side connector 30. The state shown in FIGS. 7 and 8, where the front end of the retainer projection 34 of the equipment-side connector 30 penetrates slightly into the flexibility allowance space 22 of the electric wire-side connector 10 is called a temporary fit-on state. In this state, as shown in FIG. 8, the rod-shaped front end 56A of the fit-on bolt 56 penetrates into the threaded hole 66, but the screw shaft 56B thereof has not engaged the threaded hole 66.

Figure 9:
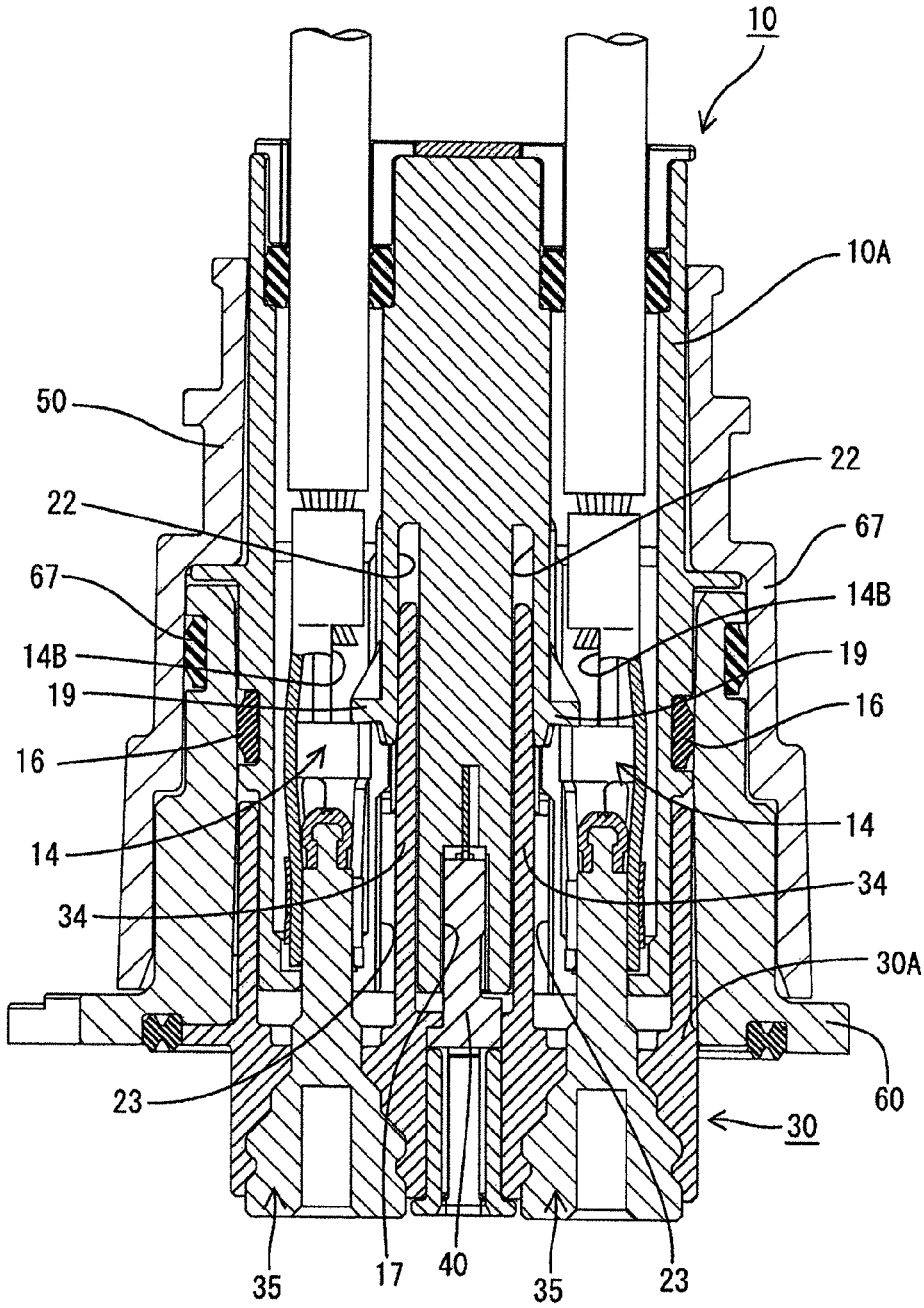
FIG. 9 is a front-side sectional view showing a state in which the electric wire-side connector is normally fitted on the equipment-side connector in the embodiment.
Figure 10:
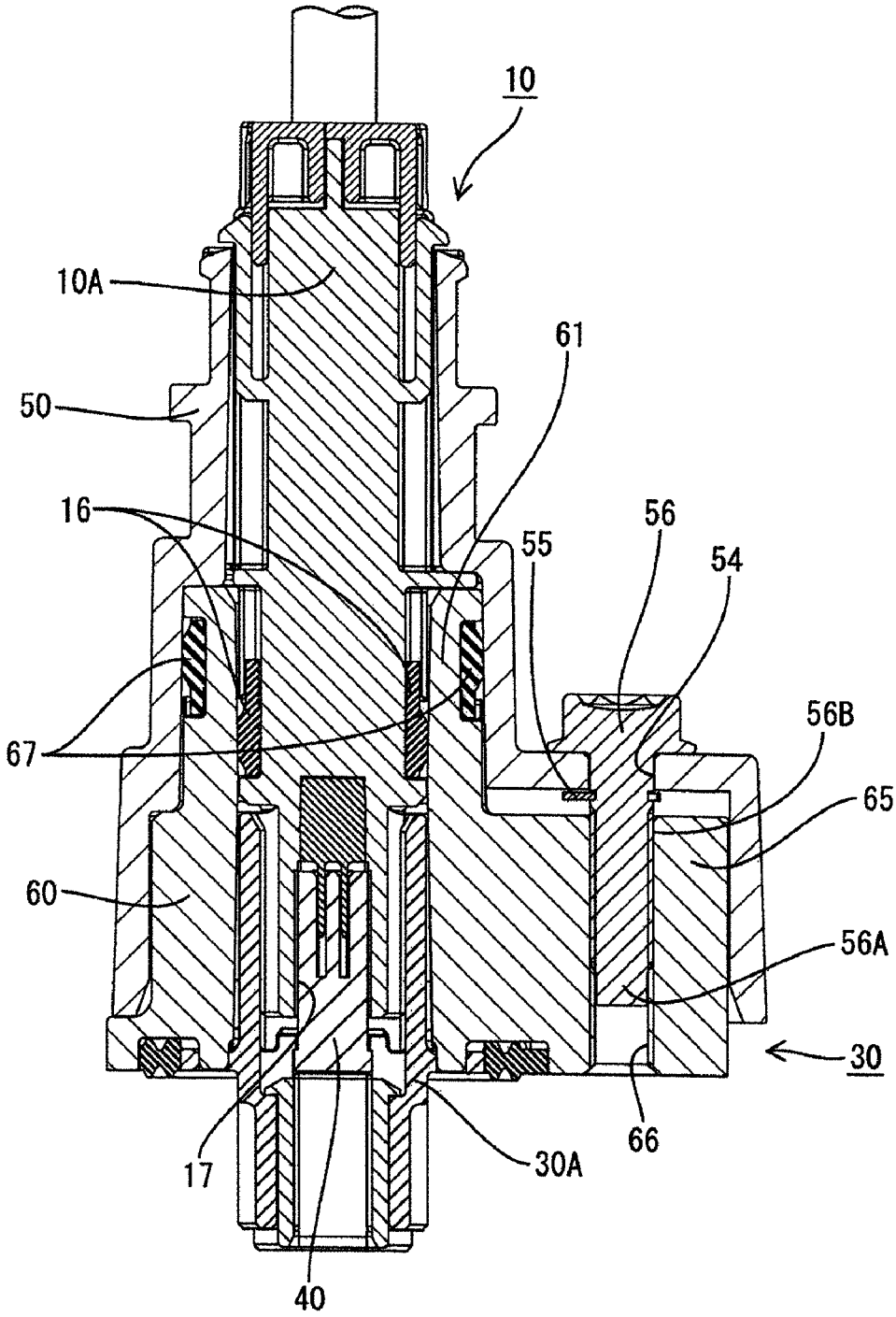
FIG. 10 is a side sectional view showing the state shown in FIG. 9.

The equipment-side connector 30 and the electric wire-side connector 10 are pressed from the temporary fit-on state so that the retainer projection 34 penetrates deeper into the flexibility allowance space 22. Thus, the fit-on groove 34A is fit on the back 19B of the lance 19 and the retainer projection 34 penetrates deep into the flexibility allowance space 22. As a result, the screw shaft 56B of the fit-on bolt 56 engages the threaded hole 66 of the second shielding shell 60. The fit-on bolt 56 then is rotated with a wrench to screw the fit-on bolt 56 into the threaded hole 66, thereby causing the first and second shielding shells 50 and 60 to approach each other. As shown in FIGS. 9 and 10, the electric wire-side connector 10 and the equipment-side connector 30 have a completed fit-on state in which the pin 37 is inserted completely into the female terminal 14 to obtain a conductive state. In this state, the shielding-side rubber ring 67 mounted on the edge of the periphery of the second body 61 closely contacts the inner peripheral surface of the first shielding shell 50 fit on the peripheral surface of the second shielding shell 60, the inner peripheral surfaces of the first and second shielding shells 50 and 60 are waterproofed.

In the fit-on finish state, the entire retainer projection 34 is in the flexibility allowance space 22 and prevents the lance 19 from flexing in an unlocking direction. Thus, the lance 19 will not unlock from the retainer projection 34 even if a pulling force is applied to the electric wire 13. Therefore, the female terminal 14 is locked doubly and cannot escape the cavity 12.

The interlocking connector 40 is fit on the interlocking fit-on part 17 when the electric wire-side connector 10 is fit on the equipment-side connector 30. Thus, an unshown fit-on detection circuit detects that the electric wire-side connector 10 is fit on the equipment-side connector 30. As a result, a relay or the like is closed and a power circuit is energized.

As described above, the retainer projection 34 on the electric wire-side connector 10 prevents the lance 19 of the equipment-side connector 30 from flexing, thus preventing the female terminal 14 from being removed from the cavity 12. Therefore it is not necessary to provide the electric wire-side connector 10 with a retainer for doubly locking the lance 19 or a locking mechanism for retaining the retainer on the electric wire-side connector 10.

The lance 19 will not be in a normal locking state if the female terminal 14 is not inserted sufficiently into the cavity 12 and part of the lance 19 will project into the flexibility allowance space 22. Thus, the front end of the retainer projection 34 will contact the lance 19 while fitting the electric wire-side connector 10 on the equipment-side connector 30 and the retainer projection 34 cannot penetrate into the flexibility allowance space 22. Accordingly, the electric wire-side connector 10 cannot be fit on the equipment-side connector 30 and even the semi-fit-on state cannot be obtained. An operator immediately can detect that the female terminal 14 is in a locking-inadequate state.

The length of the screw shaft 56B of the fit-on bolt 56 is set so that the screwing of the fit-on bolt 56 into the threaded hole 66 starts after the electric wire-side connector 10 has been fit on the equipment-side connector 30 sufficiently for the front end of the retainer projection 34 to penetrate into the flexibility allowance space 22. The screw shaft 56B of the fit-on bolt 56 engages the thread groove of the threaded hole 66 after the electric wire-side connector 10 is fit temporarily on the equipment-side connector 30. Thus, even though an electric tool, such as an impact wrench, is used when the female terminal 14 is in the locking-inadequate state, the electric wire-side connector 10 and the equipment-side connector 30 do not have even a temporary fit-on state and there is no fear that the fit-on bolt 56 is screwed into the threaded hole 66. Accordingly, the lance 19 and the retainer projection 34 will not be broken because the electric wire-side connector 10 cannot be fit forcibly on the equipment-side connector 30 in the locking-inadequate state.

The retainer projection 34 is formed integrally with the second housing 30A and guides the electric wire-side connector 10 onto the equipment-side connector 30 in the correct direction. The fit-on groove 34A of the retainer projection 34 engages the lance 19 and surrounds the back 19B of the lance 19. Thus, the retainer projection 34 assures the proper vertical orientation of the electric wire-side connector 10 in the equipment-side connector 30 so that the electric wire-side connector 10 and the equipment-side connector 30 can be moved into the fit-on state. The electric wire-side connector 10 is fit on the equipment-side connector 30 correctly due to the above-described guide function of the retainer projection 34.

The retainer projection 34 is unitary with the second housing 30A, thereby reducing the number of component parts and making the connector compact. The conventional connector that has the retainer separate from the housing must have a locking mechanism on the electric wire-side connector 10 for holding the retainer. However, the retainer projection 34 of the subject invention is formed integrally with the second housing 30A. Thus, the electric wire-side connector 10 does not need the locking mechanism used in the conventional connector and the connector is compact.

The retainer projection 34 is near the center of the second housing 30A, thereby improving the strength of the retainer projection 34 and preventing the retainer projection 34 from being broken, because both connectors cannot be forcibly fit together.

The invention is not limited to the embodiments described above with reference to the drawings. For example, the following embodiments are also included in the technical scope of the present invention.

The above-described connector has the bolt 56 screwed into the threaded hole 66 to fit the first and second shielding shells 50 and 60 together and to fit the electric wire-side connector 10 on the equipment-side connector 30. However, the electric wire-side connector 10 may be fit on the equipment-side connector 30 by using a known lever mechanism.

The above-described lance 19 is disposed at approximately the center of the first housing 10A in its width direction, and the two retainer projections 34 are formed by forward extending the laterally extended side walls of the interlocking accommodation part 38 in the direction in which the electric wire-side connector 10 fits on the equipment-side connector 30. However, the invention is not limited to the above-described form. For example, the lance 19 may be disposed at both sides of the first housing 10A in its width direction, the flexibility allowance space 22 is provided outward from each cavity 12, and the retainer projections 34 are inserted into both sides of the first housing 10A1 in its width direction.

What is claimed is:

1. A connector assembly comprising:

a first housing having opposite front and rear ends and cavities extending through the first housing from the front end to the rear end, resiliently deformable lances formed in the first housing and projecting at least partly into the respective cavities, flexibility allowance spaces in the first housing on a sides of the lances opposite the respective cavity, the lances being deformable into the respective flexibility allowance spaces;

first terminal fittings in the respective cavities of the first housing and being locked by the respective lances, the first terminal fittings being removable from the cavities when the lances are deformed into the respective flexibility allowance spaces;

a second housing having second terminal fittings mounted therein and being configured to be fit together with the first housing along a fit-on direction, retainer projections unitary with the second housing and projecting in the fit-on direction, the retainer projections penetrating into the flexibility allowance space when the first and second housings are fit together properly, thereby preventing the lances from flexing in an unlocking direction.

2. The connector assembly of claim 1, wherein said first housing has two of the cavities and two of said lances, the locking lances being at a side of each of the cavities near a center of the first housing.

3. The connector assembly of claim 2, wherein the first housing has a fit-on detection connector part between the lances and the retainer projections are disposed so that the fit-on detection connector part is sandwiched between the retainer projections when the first and second housings are fit together.

4. The connector assembly of claim 1, wherein the first and said second housings are provided with a bolt and a female screw part respectively, the bolt being screwed into the female screw part to fit the first and second housings together, a length of the bolt being set so that screwing of the bolt into the female screw part starts after a front end of said retainer projection penetrates into said flexibility allowance space during connection of the housings.

5. The connector assembly of claim 1, wherein the lances are cantilevered forward in the first housing.

6. A connector assembly comprising:

a first housing having opposite front and rear ends and first and second cavities extending through the first housing from the front end to the rear end, a fit-on detection connector part between the cavities, first and second flexibility allowance spaces between the fit-on detection connector part and the respective first and second cavities, a first resiliently deformable lance between the first cavity and the first flexibility allowance space and a second resiliently deformable lance between the second cavity and the second flexibility allowance space, the lances being deformable into the respective flexibility allowance spaces;

first terminal fittings in the respective cavities of the first housing and being locked by the respective lances, the first terminal fittings being removable from the cavities when the lances are deformed into the flexibility allowance spaces; and a second housing configured to fit together with the first housing along a fit-on direction, second terminal fittings mounted in the second housing and being connectable with the first terminal fittings when the housings are fit together, an interlocking connector mounted in the second housing between the second terminal fittings and being connectable with the fit-on detection connector part when the housings are fit together, first and second retainer projections unitary with the second housing and projecting in the fit-on direction, the retainer projections penetrating into the flexibility allowance spaces when the first and second housings are fit together properly for preventing the lances from flexing in an unlocking direction, wherein the fit-on detection connector part is sandwiched between the retainer projections when the first and second housings are fit together.

7. The connector assembly of claim 6, wherein the first and said second housings are provided with a bolt and a female screw part respectively, the bolt being screwed into the female screw part to fit the first and second housings together, a length of the bolt being set so that screwing of the bolt into the female screw part starts after a front end of said retainer projection penetrates into said flexibility allowance space during connection of the housings.

8. The connector assembly of claim 6, wherein the first and said second retainer projections are disposed between the interlocking connector and the respective second terminal fittings.

* * * * *